US005193430A

United States Patent [19]

Ilgovsky

[11] Patent Number: 5,193,430

[45] Date of Patent: Mar. 16, 1993

[54] AIR CYLINDER WITH INTERMEDIATE MECHANICAL DEAD-STOP

[76] Inventor: Adolf M. Ilgovsky, 587 Torland Ct., Sunnyvale, Calif. 94087

[21] Appl. No.: 770,591

[22] Filed: Oct. 3, 1991

[51] Int. Cl.[5] ..... F15B 15/24

[52] U.S. Cl. ..... 92/13.1; 92/13.4; 92/13.7; 92/85 A; 92/143

[58] Field of Search ..... 92/13, 13.1, 13.4, 13.7, 92/85 A, 143

[56] References Cited

U.S. PATENT DOCUMENTS 1,138,621 5/1915 Bowser ..... 92/13.4
1,554,661 9/1925 Schriner .
3,036,556 5/1962 Hamilton ..... 92/114
4,043,709 8/1977 Grevich .
4,199,344 4/1980 Mumford et al. .
4,686,870 8/1987 Mack .
4,736,675 4/1988 Stoll .

*Primary Examiner*—Edward K. Look
*Assistant Examiner*—F. Daniel Lopez
*Attorney, Agent, or Firm*—John J. Leavitt

[57] ABSTRACT

Presented is an air cylinder apparatus including a control mechanism that is operable to interject mechanical dead-stops to control the linear translation of the piston of the air cylinder to predetermined increments of travel.

6 Claims, 2 Drawing Sheets

AIR CYLINDER WITH INTERMEDIATE MECHANICAL DEAD-STOP

BACKGROUND OF THE INVENTION

1. Field of the Invention

This invention relates to air cylinders utilized to control the performance of various functions, and particularly to an air cylinder piston excursion control apparatus that enables pre-programmed precise stoppage of an air cylinder piston in either direction.

2. Description of the Prior Art

A preliminary patentability search in connection with the subject invention has revealed the existence of the following U.S. Pat. Nos.

| | | |
|---|---|---|
| 4,554,661 | 4,043,709 | 4,199,344 |
| 4,686,870 | | 4,736,675 |

Referring to the patents listed above in the order of their issuance, it is noted that U.S. Pat. No. 1,544,661 relates to a pump structure for dispensing liquids such as oil or grease, and embodies a rack and pinion arrangement for translation of the piston within a cylinder when a hand-crank is rotated. The piston rod is slidably arranged in a tubular extension, and a push-pin is adjustable in its height within the tubular extension to limit elevation of the piston rod and thereby control the amount of liquid dispensed by the pump.

U.S. Pat. No. 4,043,709 relates conceptually to a method and means of controlling an air cylinder so as to control the amount of liquid dispensed in a pumping operation. Structurally, there is provided a threaded extension rod one end of which functions as a stop. The threaded extension rod is minutely adjustable by rotation to set the stop point of the piston.

U.S. Pat. No. 4,199,344 discloses a structure operated by air that is used in the glass container industry to repeatedly shift a bottle from a cooling station to a moving conveyor. The mechanism for effecting reciprocable action is essentially a rack and pinion arrangement for rotating a shaft on which are fixed two spur gears. A pin on one of the spur gears and a bolt constituting a stop on one of the racks limits the excursion of the rack.

U.S. Pat. No. 4,686,870 discloses a double-acting air cylinder that is mounted for slidable reciprocation on a fixed piston rod and piston assembly. From one end of the reciprocable cylinder there is an extension that extends radially away from the cylinder and moves with the cylinder. Mounted laterally from the cylinder on the same framework is a turret shaft on which are locked a multiplicity of stop rods that may be adjusted incrementally and which may be rotated on the turret shaft so that the ends of the rods are abutted by the lateral extension from the cylinder. Rotation of the turret rod is effected by a pawl and ratchet mechanism.

U.S. Pat. No. 4,736,675 relates to an air cylinder in which the piston is actuated by the admission of air to the cylinder, with means attached to he piston rod to prevent the piston from rotating within the cylinder. There does not appear to be anything in this patent that suggests control of the excursion of the piston in relation to the cylinder.

There are many instances in industry in which it is expedient to use an air cylinder having a piston and piston rod and responsive to the admission of air into the cylinder to displace the piston and cause translation of the piston rod to achieve performance of a given function, say, for example the positioning of a machine part for the performance on that machine part of a grinding or cutting operation, or the assembly on it of some additional part. The use of air and air cylinders to effect such operations is frequently less complex and therefore less expensive than the use of other mechanisms, such as hydraulic, mechanical or electrical means. Accordingly, it is one of the primary objects of the present invention to provide an air cylinder and control apparatus therefor that adapts the air cylinder for use in robotic systems.

In robotic systems, it is frequently necessary that multiple and repetitive functions be performed with exactitude of position of the part being operated upon. Accordingly, another object of the present invention is the provision of an air cylinder and air cylinder control apparatus that enables exact interruption of the translation of the air cylinder piston and the rod to which it is attached at predetermined positions along its excursion path.

The prior art indicated above teaches the broad concept or idea of intermediate stoppage of an air cylinder by mechanical means. However, the prior art so far as known to me does not teach the concept of a structure for providing exact intermediate stops for the piston and piston rod of an air cylinder while traveling in both directions. Accordingly, another object of the invention is the provision of an air cylinder control apparatus that accurately provides predetermined intermediate stops for an air cylinder piston in both directions of its travel.

For effective application in a robotic system, where multiple and repetitive functions must be performed, it is an advantage if the predetermined positional limitations of the apparatus may be preprogrammed into the apparatus. Accordingly, a still further object of the invention is the provision of an air cylinder and air cylinder control apparatus that is susceptible of computer control in its operation.

The invention possesses other objects and features of advantage, some of which, with the foregoing will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the air cylinder and air cylinder control apparatus for providing intermediate dead-stops for the air cylinder piston comprises a dead-stop rod connected for translation with the piston rod and having on one end thereof a dead-stop plate, and a multiplicity of selectively adjustable dead-stop abutments against which the dead-stop plate may impinge according to the manner in which the dead-stop abutments are adjusted in relation to the dead-stop plate. Thus, in one aspect of the invention, the dead-stop abutments may be adjusted axially of the piston rod to determine the length of a given excursion, and then the dead-stop abutment may be rotated to permit continued excursion of the piston and rod in the initial direction past the dead-stop abutment. In like manner, the return excursion of the piston and piston rod may be controlled to stop in exactly the same positions by selective manipulation and control of the position of the dead-stop abutments in relation to the piston rod excursion path. To control rotative positioning of the dead-stop abutments there is provided an auxiliary air cylinder that is selectively operated to rotate a rod on which the dead-stop abutments are mounted, each of the dead-stop abutments being configured and positioned along the rod to bring into abutting position different dead-stop abutments upon predetermined incremental rotation of the rod upon which the dead-stop abutments are mounted.

DESCRIPTION OF THE PREFERRED EMBODIMENT

Figure 3:
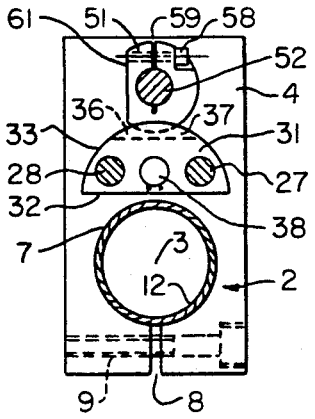
FIG. 3 is a vertical cross-sectional view of the assembly taken in the plane indicated by the line 3—3 in FIG. 2.
Figure 4:
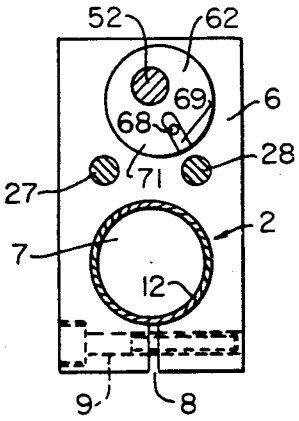
FIG. 4 is a vertical cross-sectional view of the assembly taken in the plane indicated by the line 4—4 in FIG. 2.
Figure 5:
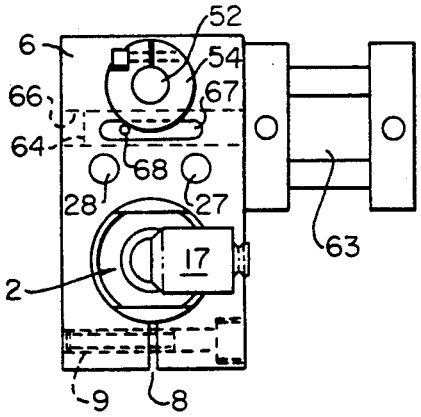
FIG. 5 is an end elevational view taken in the direction of the arrows indicated on the line 5—5 in FIG. 2.

In terms of greater detail, the air cylinder assembly incorporating an intermediate dead-stop comprises an elongated tubular air cylinder designated generally by the numeral 2, the air cylinder being symmetrical about a longitudinal axis 3, and being supported at opposite ends by support blocks 4 and 6, with the support blocks being generally rectangular as illustrated in FIGS. 3-5. Each of the support blocks has a bore 7 to receive the outer periphery of the generally cylindrical air cylinder 2. The bore 7 in each of the support blocks communicates with a slot 8 that enables expansion of the lower end of the block so as to easily slidably accommodate the cylindrical surface of the air cylinder. A clamp screw 9, applied as shown in each support block, extends across a slot 8 and threadably engages a complementarily threaded bore on the opposite side of the slot so that when the clamp screw is tightened, sufficient compressive force is imposed on the outer cylindrical surface of the air cylinder so as to tightly clamp the air cylinder in the bores 7 of the support blocks as shown.

The air cylinder is preferably of the double-acting type, having within the cylindrical bore 12 of the air cylinder, and adapted to be slidably translated in a selected direction therewithin, an appropriate piston 13, having appropriate air seal means 14 such as an "0" ring or a "quad" ring, to effectively seal the slidable union of the periphery of the piston with the inner cylindrical bore surface of the air cylinder against the passage of air. Mounted on opposite ends of the air cylinder are air inlet and outlet fittings 16 and 17, each having inlet and outlet passageways as is conventional in this type of fitting to admit air into the air cylinder and to permit egress of air therefrom. As illustrated in the drawings, the air fitting 16 is mounted on a sleeve 18 sealingly engaged to one end of the air cylinder 2, the air fitting 16 extending transversely away from the coupling sleeve 18. The coupling sleeve provides a bearing portion 19, externally threaded to receive a nut 21. The bearing extension 19, internally is provided with conventional seal means (not shown) adapted to seal about the actuating shaft 22 of the air cylinder. The opposite end 23 of the actuating shaft 22 is operatively connected to the piston 13 as shown.

Figures 1, 1A, 2, 2A:
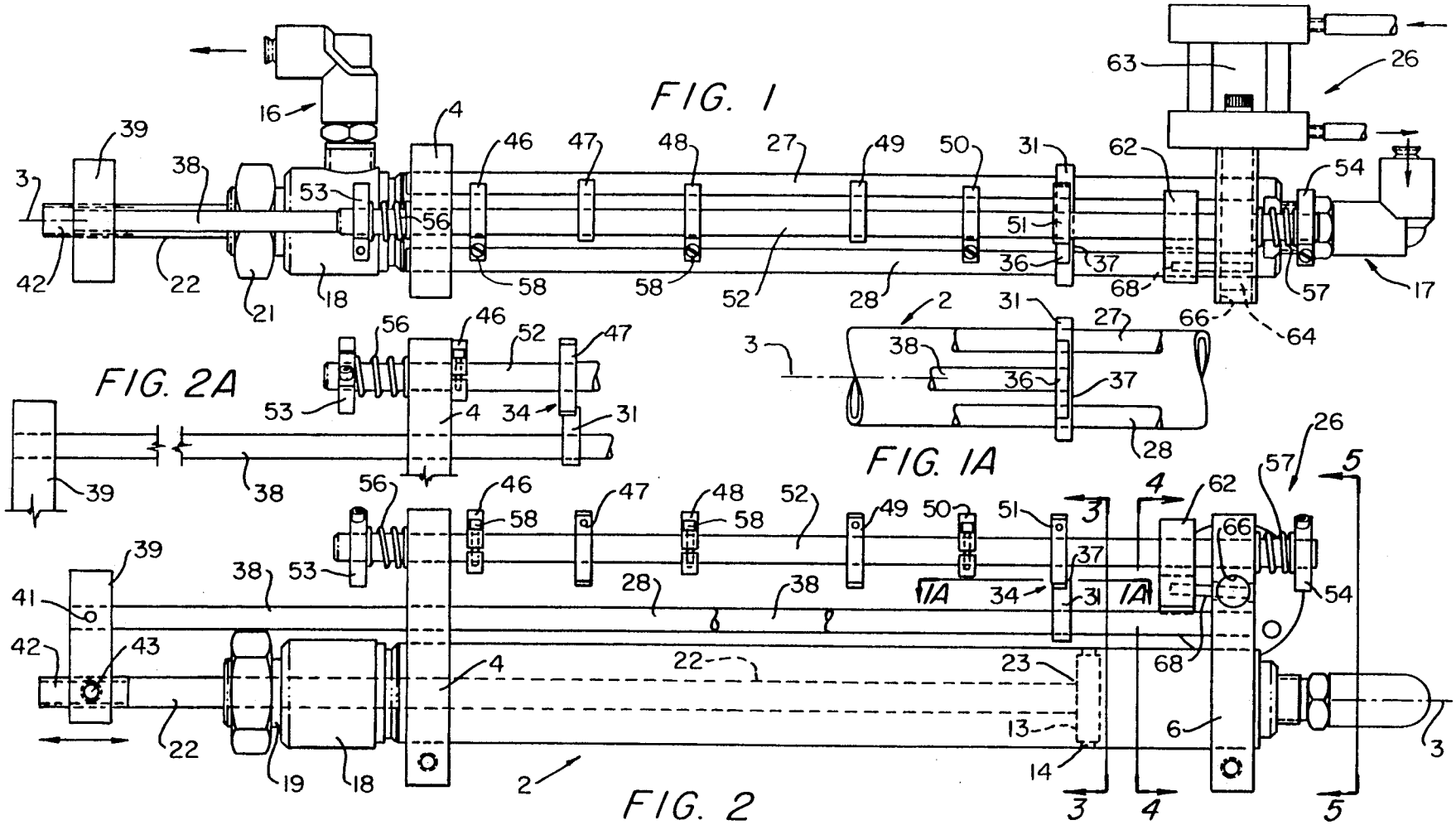
FIG. 1 is a plan view of the air cylinder and air cylinder control apparatus of the invention shown in assembled form.
FIG. 1A is a fragmentary horizontal elevational view in plan taken in the plane indicated by the line 1A—1A in FIG. 2.
FIG. 2 is a side elevational view of the assembly illustrated in FIG. 1.
FIG. 2A is a fragmentary side elevational view of the assembly illustrating the dead-stop rod and dead-stop plate shifted to abut a different dead-stop abutment.

Thus, when air is admitted into the air cylinder through the fitting 17, the piston 13 moves to the left as viewed in FIG. 2, and any air within the interior of the air cylinder behind the piston 13 egresses through the fitting 16. Conversely, when air is admitted into the air cylinder through the fitting 16, the piston 13 moves to the right as viewed in FIG. 2, and air ahead of the piston egresses through the fitting 17. Thus, axial translation of the piston may be controlled by the admission of air into a selected one of the fittings 16 and 17.

As stated above, one of the objects of the present invention is to control the axial translation of the piston within very close limits in either direction of travel. To accomplish the precise control of the axial translation of the piston within the air cylinder, control means designated generally by the numeral 26, are provided to interject positive dead-stops along the translation path of the piston 13 to limit linear translation of the piston and piston rod in relation to the cylinder.

Such control means includes a pair of guide rods 27 and 28 opposite ends of which are secured in appropriate bores in opposite support blocks 4 and 6 as shown. They may be detachably secured thereto by appropriate set screws (not shown). The guide rods 27 and 28 extend longitudinally of the air cylinder 2, parallel to the longitudinal axis 3 thereof, but spaced on opposite sides of the axis as illustrated in FIG. 1, and elevated thereabove as illustrated in FIG. 2. Preferably, as illustrated in FIGS. 3-5, the guide rods 27 and 28 both lie in a common plane. Mounted on the guide rods 27 and 28 for slidable movement in relation thereto is a dead-stop plate 31 having a semi-circular configuration including a flat bottom surface 32 extending diametrically across the plate. A cylindrically curved surface 33 intercepting opposite ends of the diametrically extending flat surface 32 of the plate is shown in FIG. 3. The dead-stop plate 31 has appreciable thickness in an axial direction in relation to the axis of the air cylinder and the axes of the guide rods 27 and 28 on which it is slidably mounted. There is provided in the circular periphery 33 a notch designated generally by the numeral 34 (FIGS. 2, 2A and 3), the notch including a flat bottom 36 parallel to the flat diametrically extending surface 32, and a flange 37 projecting above the flat surface 36 to form a stop or abutment flange as will hereinafter be explained.

The dead-stop plate 31 is fixedly mounted on the end of a dead-stop rod 38 which, intermediate its ends, is slidably journaled in the support block 4, and which, at its end opposite the dead-stop plate 31, is fixed to a mounting block 39 by a pin 41 as shown. The opposite end of the mounting block 39 is adjustably mounted on the threaded end portion 42 of the piston actuator shaft 22. The mounting block is secured to the shaft 22 of the air cylinder by an appropriate set screw 43. It should be understood that the mounting block or bracket 39, when detached from the dead-stop rod 38 by withdrawal of the pin 41, may be rotated on the threaded portion 42 of the actuator shaft to position the mounting bracket or block 39 in precisely the position required for any given situation. It will thus be seen that with the dead-stop rod 38 slidably journaled in the support block 4, and the opposite end of the dead-stop rod secured to the dead-stop plate 31, and with the dead-stop plate 31 slidably journaled on the two guide rods 27 and 28, axial displacement of the piston within the air cylinder by application of air to one or the other of the air fittings 16 or 17, will effect axial translation of the dead-stop rod and the dead-stop plate, if unimpeded, to the same extent that the piston travels within the air cylinder.

Since it is one of the objects to control the extent of axial translation of the piston within the air cylinder, means designated generally by the numeral 44 are provided for precisely limiting axial translation of the dead-stop plate 31 and consequently of the piston 13. Such means includes a multiplicity of abutment plates 46, 47, 48, 49, 50 and 51 mounted at selectively adjustable spaced intervals along a mounting shaft 52, opposite ends of which are slidably and rotatably journaled in the support blocks 4 and 6 in which the air cylinder is mounted. Outboard of the cylinder-mounting support blocks 4 and 6 there is mounted on the opposite end portions of the mounting shaft 52, clamp plates 53 and 54, each spaced from the adjacent side of the associated support blocks 4 and 6, to provide a space within which may be mounted compression springs 56 and 57 as shown. It will thus be seen that axial translation of the mounting shaft in a selected direction works to compress either the spring 56 or the spring 57, so that upon release of the external force tending to shift the mounting shaft 52 one way or the other, the springs 56 and 57 cooperate to return the mounting shaft 52 to a position of equilibrium. It should also be noted that by clamping the clamp plates 53 and 54 closer or farther away from the associated mounting blocks 4 and 6, the amount of compression exerted on each of the springs can be modified, so that the amount of external force required to shift the mounting shaft 52 axially may also be controlled.

The abutment plates 46—51 are identical in configuration and purpose, and each constitutes a semi-circular metallic plate centrally bored to receive the mounting shaft 52. Each is provided with a clamp screw 58 (FIG. 3) theadably engaging a peripheral portion of the plate and extending across a slot 59 so that tightening the screw effects clamping of the abutment plate on the shaft 52. As illustrated in FIG. 3, each abutment plate is provided with a flat surface 61 parallel to the slot 59, and offset laterally from the central axis of the cylindrical mounting shaft 52. Referring to FIG. 3, it will be seen that the orientation of the; abutment plate 51 in relation to the dead-stop plate 31, is such that a portion of the cylindrical periphery of the abutment plate 51 extends into the notch 34 so that there is an overlapping relationship between the flange 37 on the dead-stop plate 31 and a peripheral portion of the abutment plate 53. Comparing FIG. 3 with FIG. 2, it will be seen that the abutment plates 47 and 49 are arranged in the same orientation as the abutment plate 51, while the abutment plates 46, 48, and 50 are rotated 90 degrees about the axis of the mounting shaft 52 so as to present a different orientation from that displayed by the abutment plates 47, 49 and 51.

Figure 6:
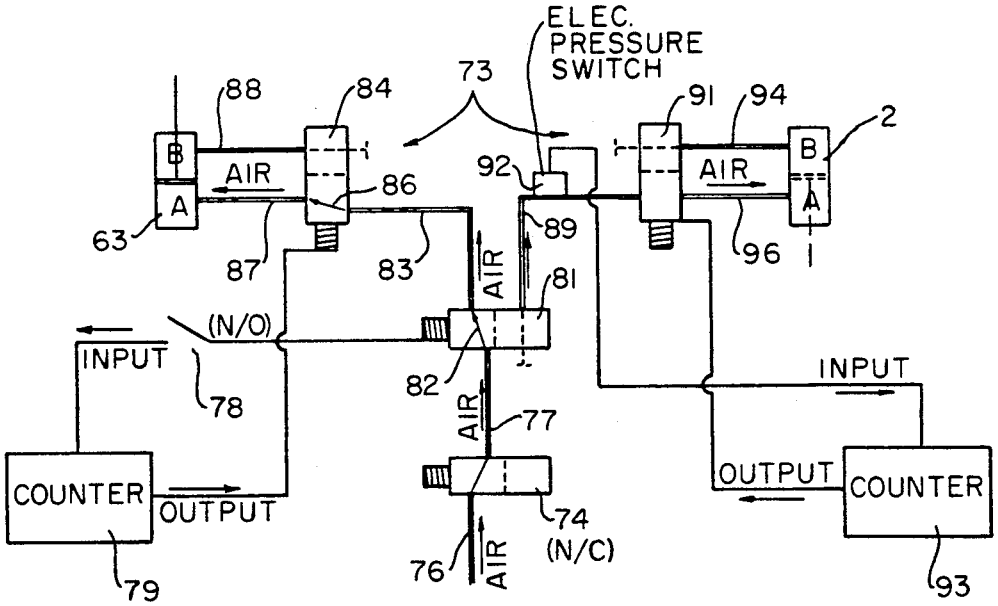
FIG. 6 is a schematic view of a control circuit operative for controlling operation of the air cylinder and intermediate dead-stop assembly of the invention.

It will thus be seen that with the piston 13 of the air cylinder in its extreme position at the right end of the air cylinder as viewed in FIG. 2, injection of air into the air fitting 17 will cause the piston to move to the left, pushing the actuator rod 22 ahead of it, and pulling the dead-stop rod 38 so as to cause the dead-stop plate 31 to move to the left at the same rate as the neutral piston in the air cylinder. In the position of the parts illustrated, the flange 37 of the dead-stop plate 31 impinges lightly against the abutment plate 51. When air under pressure is admitted through fitting 17, the when build-up of pressure within the air cylinder 2 upon impact of the dead-stop plate 31 with the abutment plate 51, causes an increase in the force exerted on the abutment plate by the dead-stop plate 31, thus shifting the mounting shaft 52 axially to the left as viewed in FIGS. 1 and 2, causing the abutment plate 46 associated with the opposite end of the mounting shaft 52 to come into firm abutting contact with the mounting block 4 as illustrated in FIG. 2A. At this point, a first electrical signal, initiated by abutment plate 46 closing switch 78, is transmitted to the control circuit illustrated schematically in FIG. 6, indicating that the piston has come to a dead-stop. The piston may be retained in this position for whatever interval is necessary to accomplish the purpose for which the air cylinder was actuated.

Under these circumstances, and referring again to FIGS. 2A and 3, it will be seen that if the mounting shaft 52 is now rotated 90° counter-clockwise momentarily as viewed in FIG. 3, the flat surface 61 of the abutment plate 51 will be brought into alignment with the flat surface 36 of the dead-stop plate 31. This releases the shaft 52 which is moved to the right by spring 57, thus open the switch 78 and breaking the circuit previously closed and thus sending a second signal to the control circuit. Rotation of the shaft 52 thus provides clearance for and releases the dead-stop plate 31, permitting the pressure build-up in the air cylinder 2 to again move the dead-stop rod 38 to the left, together with the dead-stop plate 31, until the dead-stop plate 31 comes into abutting relationship with the abutment plate 49, whereupon the mounting shaft 52 is again moved to the left until the abutment plate 46 again abuts the support block 4 and again closes switch 28 (FIG. 6) again sending a first signal to the control circuit as previously described. Again, if it is desired for any particular reason to have the dead-stop plate 31 continue in its translation to the left past the abutment plate 49, mounting shaft 52 is again rotated momentarily counter-clockwise, removing the abutment plate 49 from the path of travel of the dead-stop plate 31, thus permitting the dead-stop plate 31 to travel between the position of the stop-plate 49 and the next successive stop-plate 47. Simultaneously, the shaft 52 moves to the right to a position of equilibrium, again, interrupting the first signal and by such interruption sending a second signal to the control circuit as before.

It will thus be seen that the exact location of stoppage of the piston within the cylinder may be selectively controlled by setting the positions of the abutment plates along the mounting shaft 52, by setting their angular orientation with respect to the dead-stop plate, and by setting the position of the abutment plate 46 in relation to the associated adjacent support block 4. By selecting the width of the space between these two members, and the free travel of the clamp plate 54 against the resistance of the spring 57, it will be seen that the length of the interval of time between the contact of the dead-stop plate with the first abutment plate and subsequent contact of the abutment plate 46 with the support block 4 and transmission of the first signal may be closely controlled.

When the dead-stop plate 31 has reached its left-most position associated next to the support block 4, the operation may now be reversed and air may be admitted into the air cylinder through the air inlet fitting 16, whereupon the dead-stop plate 31 may now be controlled as to the extent of its linear translation to the right by controlling the positions of impact of the dead-stop plate with the opposite side surfaces of the abutment plates. When the operation is reversed, a dead-stop is achieved when axial displacement of the shaft to the right is interrupted, whereupon a first signal is transmitted to the control circuit. A second signal is transmitted when the shaft 52 moves to the left to a position of equilibrium after rotation of the abutment plates to release the dead-stop plate.

As discussed above, all that is required to release the dead-stop plate 31 from one of the positions in which its translation to the right, and that of the piston 13, have been stopped, is to momentarily pivot the shaft 52 on which the abutment plates are mounted through about 90° so as to place the flat surface 61 of the abutted abutment plate in a parallel relationship with the flat surface 36 of the notch 34 of the dead-stop plate. This will then provide clearance between the abutment plate and the dead-stop plate and permit the dead-stop plate to continue its translation to the right until it abuts the next abutment plate. Pivotal rotation of the mounting shaft is only momentary so as to interrupt the circuit responsible for the first signal and to reposition the next succeeding abutment plate in the path of the dead-stop plate so as to again control the extent of translation of the piston within the air cylinder. It should also be noted that as soon as the shaft 52 is rotated to release the dead-stop plate, the spring 56, having been compressed, moves the shaft 52 to the left to a position of equilibrium and breaks the circuit that was made when the stop block 62 impinges against the associated side of support block 6 to accomplish a dead-stop in this direction.

Means are provided operatively associated with the abutment plates and the mounting shaft on which they are mounted to effect controlled pivotal rotation of the mounting shaft to thereby rotate selected ones of the abutment plates to either clear a path for translation of the dead-stop plate or place one or more abutment plates in the path of the dead-stop plate to control the extent of its movement, and through such controlled movement, control the extent of movement of the piston within the air cylinder.

Such means for controlling rotation of the abutment plate mounting shaft 52 includes an auxiliary double-acting commercial air cylinder 63 mounted on the support block 6 for the main air cylinder 2. The air cylinder 63, through the appropriate injection of air controlled by the control circuit shown schematically in FIG. 6, causes controlled reciprocation of an elongated piston rod 64 slidably disposed in an accommodating bore 66 formed in the support block 6 as shown, the bore 66 extending transversely through the support block. Formed in the support block parallel with the elongated piston rod is a transversely extending slot 67 as illustrated in FIG. 5. The slot 67 slidably accommodates a connecting rod 68 one end of which is secured to the associated end portion of the elongated piston rod so that when the piston rod reciprocates within the bore 66, the connecting rod slides transversely along the slot. The connecting rod extends away from the piston rod at a 90 angle cantilever-like, and the free end of the connecting rod is slidably received in a radially extending slot 69 formed in crank plate portion 71 forming an integral part of stop block 62 and fixedly secured to the mounting shaft 52 adjacent the inboard side of the support block 6 as shown.

It will thus be seen that controlled injection of air into the auxiliary double-acting air cylinder 63 effects lateral translation of the piston rod and the attached connecting rod. Since the end of the connecting rod remote from the piston rod is slidably received in the slot 69 of the crank plate portion of the stop block 62 fixedly secured to the rotatably mounted shaft 52, such lateral translation of the connecting rod imposes a rotary moment on the crank plate portion, and causes rotation of the crank plate portion and the attached mounting shaft 52, thus controlling the orientation of the abutment plates in relation to the dead-stop plate.

To implement the control described above, reference is now made to FIG. 6, where in there is illustrated schematically one forming a control circuit designated generally by the numeral 73. The control circuit includes both electrical and pneumatic control elements, such as the auxiliary double-acting air cylinder 63 shown in FIGS. 1, 5 and 6. Also included in the control circuitry is an electrically energized solenoid controlled air valve designated generally by the numeral 74 which connects the control circuit with a source of air under pressure through an appropriate inlet line 76 when the solenoid is electrically energized as when the main power switch (not shown) is turned on to energize the system, but is opened to admit air under pressure to the line 77 when selectively energized the air valve 74 is closed by spring press 74 in the event of an emergency as when an electrical power failure occurs. Also included in the control circuitry 73 is a normally open master switch 78 which is conveniently mounted on the air cylinder 2, or which, alternatively, may be mounted on the, mounting block 4, and in position to be actuated to close the switch to permit the passage of an electric current (first signal) therethrough from an electrical power source thereof (not shown) when the abutment plate 46 comes to a dead-stop against the support block 4 as indicated in FIG. 2A.

Upon closing of the normally open master switch 78 and the passage of an electrical signal therethrough, the counter 79 is activated and three-way solenoid valve 81 is actuated. Three-way valve 81 is designed to receive air through line 77 and to deliver air to line 89 and main cylinder 2 as soon as the system is powered and prior to closing of switch 78. When switch 78 closes, valve 81 is actuated to shift the valve 82 so as to cause air under pressure to flow into air line 83 (as shown) which communicates with solenoid actuated three-way valve 84. Three-way valve 84 is designed to receive pressure air from line 83 and to deliver pressure air to one or the other of lines 87 or 88. When the system is initially powered, air under pressure flows directly through lines 77, valve 81, line 89, valve 91, line 94 to cylinder 2. Upon initial closing of switch 78 by displacement of plate 46 and actuation of the counter 79, an electrical output signal from the counter, after a preset or predetermined interval, is imposed on solenoid controlled valve 84, shifting the valve 86 so that air flows into air line 87 and auxiliary air control cylinder 63 ahead of the piston, thus retracting the piston rod 64 within the bore 66, and actuating the crank plate to pivote the mounting shaft 52 on which are mounted the abutment plates 46-51 in a counterclockwise direction to bring the flat surface 61 of abutment plate 51, for instance, into opposed parallelism with the flat surface 36, thus permitting the dead stop plate 31 to slip past the abutment plate. When this occurs, the spring 57 immediately moves the shaft 52 to a neutral position, opening switch 78. Since opening and closing of the main switch 78 and actuation of the solenoid 84 is cyclical, i.e., every second output pulse, the counter 79 counts the cycles and on every second cycle again sends an actuating pulse to the solenoid controlled valve 84 to again effect translation of the piston rod 64 in the opposite direction to rotate the shaft 52 to its original position. Also, since the mounting shaft 52 is spring-pressed to shift the mounting shaft axially to the right as viewed in FIGS. 1 and 2, the main switch 78 is again opened, solenoid valve 81 is deactivated, as is solenoid valve 84, and air line 77 is connected through the three-way valve 81 with the air line 89 that communicates with solenoid actuated three-way valve 91, actuation of which controls the admission of air into the air cylinder 2.

When air line 89 is pressurized, pressure responsive electric switch 92 is actuated to energize the counter 93, which now takes over the control of actuation of the solenoid actuated three way valve 91 to control the direction of movement of piston 13. Thus, since the solenoid air distribution valve 91 is spring-pressed to normally air distribution valve 91 is spring-pressed to normally permit the passage of air under pressure through air line 94 to effect extension of the piston in air cylinder 2, when the counter 93 output is applied to the solenoid valve 91, the valve is shifted to permit passage of air under pressure to the air cylinder 2 through the air line 96, thus causing retraction of the piston rod in the air cylinder 2.

From the foregoing it will thus be seen that a dead-stop assembly is provided for implementation with an air cylinder in such a manner that very precise control may be exercised over the extent of travel of the piston 13 within the air cylinder controlled by the dead-stop assembly.

Having thus described the invention, what is believed to be novel and sought to be protected by letters patent of the United States is as follows.

I claim:

1. In combination, a linear double-acting air cylinder apparatus including first and second axially spaced support blocks on which an air cylinder is fixedly mounted and a piston reciprocable within the air cylinder and a piston rod connected at one end to the piston and extending sealingly out of the air cylinder at its other end, and control means providing intermediate dead-stops to limit linear translation of the piston and piston rod in relation to the air cylinder, said control means including:

a) a dead-stop rod connected for translation with said piston rod and having on one end thereof a dead-stop plate;

b) a shaft parallel to said dead-stop rod mounted for movement in relation to said air cylinder;

c) a multiplicity of adjustable abutment plates mounted on said shaft axially spaced therealong and against which said dead-stop plate may selectively abut to interrupt linear translation of said piston and piston rod; and d) means operatively associated with said multiplicity of adjustable abutment plates selectively operable to move said shaft and the abutment plates mounted thereon to remove selected ones of said abutment plates from the translation path of said dead-stop plate;

e) wherein said abutment plates include a circular peripheral surface portion symmetrical about said shaft and a flat chordal surface portion intercepting said circular peripheral surface portion, and said dead-stop late includes a circular peripheral surface portion and a chordal surface portion cooperating with said circular peripheral surface portion to form a dead-stop flange on said dead-stop plate, whereby said abutment plates may be shifted to place their chordal surface portions parallel to the chordal surface of said dead-stop plate to thereby remove said abutment plates from the path of said dead-stop plate.

2. In combination, a linear double-acting air cylinder apparatus including first and second axially spaced support blocks on which an air cylinder is fixedly mounted and a piston reciprocable within the air cylinder and a piston rod connected at one end to the piston and extending sealingly out of the air cylinder at its other end, and control means providing intermediate dead-stops to limit linear translation of the piston and piston rod in relation to the air cylinder, said control means including:

a) a dead-stop rod connected for translation with said piston rod and having on one end thereof a dead-stop plate;

b) a shaft parallel to said dead-stop rod mounted for movement in relation to said air cylinder;

c) a multiplicity of adjustable abutment plates mounted on said shaft axially spaced therealong and against which said dead-stop plate may selectively abut to interrupt linear translation of said piston and piston rod; and d) means operatively associated with said multiplicity of adjustable abutment plates selectively operable to move said shaft and the abutment plates mounted thereon to remove selected ones of said abutment plates from the translation path of said dead-stop plate;

e) wherein said shaft is slidably and rotatably mounted on said support blocks that support said air cylinder and include shaft end portions projecting past said support blocks, clamp blocks adjustably mounted on said shaft end portions spaced from the associated support blocks, and spring means interposed between said clamp blocks and said support blocks, whereby axial displacement of said shaft in either direction is resiliently resisted by said spring means.

3. In combination, a linear double-acting air cylinder apparatus including first and second axially spaced support blocks on which an air cylinder is fixedly mounted and a piston reciprocable within the air cylinder and a piston rod connected at one end to the piston and extending sealingly out of the air cylinder at its other end, and control means providing intermediate dead-stops to limit linear translation of the piston and piston rod in relation to the air cylinder, said control means including:

a) a dead-stop rod connected for translation with said piston rod and having on one end thereof a dead-stop plate;

b) a shaft parallel to said dead-stop rod mounted for movement in relation to said air cylinder;

c) a multiplicity of adjustable abutment plates mounted on said shaft axially spaced therealong and against which said dead-stop plate may selectively abut to interrupt linear translation of said piston and piston rod; and ) means operatively associated with said multiplicity of adjustable abutment plates selectively operable to move said shaft and the abutment plates mounted thereon to remove selected ones of said abutment plates from the translation path of said dead-stop plate;

e) wherein one of said abutment plates is fixed to said shaft spaced a predetermined distance from the first support block to form a gap, and said shaft is movable in a direction to eliminate said gap and place the abutment plate in abutting relation against the support block by movement of said air cylinder piston rod in a direction out of said cylinder.

4. The combination according to claim 3, wherein a stop block not an abutment plate is fixed on said shaft spaced a predetermined distance from a second one of said air cylinder support blocks to form a gap, and said shaft is movable in a direction to eliminate said gap and place the stop block in abutting relation against the associated second support block.

5. In combination, a linear double-acting air cylinder apparatus including first and second axially spaced support blocks on which an air cylinder is fixedly mounted and a piston reciprocable within the air cylinder and a piston rod connected at one end to the piston and extending sealingly out of the air cylinder at its other end, and control means providing intermediate dead-stops to limit linear translation of the piston and piston rod in relation to the air cylinder, said control means including:

a) a dead-stop rod connected for translation with said piston rod and having on one end thereof a dead-stop plate;

b) a shaft parallel to said dead-stop rod mounted for movement relation to said air cylinder;

c) a multiplicity of adjustable abutment plates mounted on said shaft axially spaced therealong and against which said dead-stop plate may selectively abut to interrupt linear translation of said piston and piston rod; and d) means operatively associated with said multiplicity of adjustable abutment plates selectively operable to move said shaft and the abutment plates mounted thereon to remove selected ones of said abutment plates from the translation path of said dead-stop plate;

e) wherein said means selectively operable to move said shaft and the abutment plates mounted thereon includes a crank mounted on said shaft, and means for selectively rotating said crank through a predetermined arc to effect selective rotation of said shaft and said abutment plates to place selected ones of said abutment plates in the path of said dead-stop plate or remove said selected ones of said abutment plates from the path of said dead-stop plate; and f) wherein said means for selectively rotating said crank includes an auxiliary air cylinder having a piston rod extending therefrom and selectively reciprocable in relation to said auxiliary air cylinder by selective admission of air to said auxiliary air cylinder, and a connecting rod mounted on said piston rod and engaging said crank to effect rotation of said crank upon reciprocation of said piston rod.

6. The combination according to claim 5, wherein said auxiliary air cylinder is mounted on one of said air cylinder support blocks, and said piston rod is slidably mounted in a bore extending perpendicular to said shaft.

* * * * *